US008397702B2

(12) United States Patent
Anderson et al.

(10) Patent No.: US 8,397,702 B2
(45) Date of Patent: Mar. 19, 2013

(54) CONTROL CIRCUIT FOR CAPACITOR DISCHARGE IGNITION SYSTEM

(75) Inventors: Brian E. Anderson, Bay City, MI (US); Gerald J. LaMarr, Jr., Bay City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 925 days.

(21) Appl. No.: 12/497,830

(22) Filed: Jul. 6, 2009

(65) Prior Publication Data

US 2011/0000471 A1 Jan. 6, 2011

(51) Int. Cl.
*F02P 3/06* (2006.01)
*F02P 1/00* (2006.01)

(52) U.S. Cl. ..... 123/605; 123/599

(58) Field of Classification Search ..... 123/596, 123/599, 605, 618, 648, 655, 198 DC, 406.57; 324/378, 380, 382; 315/209 CD; 361/254, 361/256

See application file for complete search history.

(56) References Cited

U.S. PATENT DOCUMENTS

| | | | | |
|---|---|---|---|---|
| 4,236,494 | A * | 12/1980 | Fairchild | 123/630 |
| 4,951,625 | A * | 8/1990 | Okuda | 123/198 DC |
| 5,878,709 | A | 3/1999 | Andersson et al. | |
| 7,069,921 | B1 * | 7/2006 | Kolak et al. | 123/599 |
| 7,156,075 | B2 * | 1/2007 | Kiessling | 123/406.56 |
| 7,706,960 | B2 * | 4/2010 | Nishida et al. | 701/112 |

* cited by examiner

*Primary Examiner* — Stephen K Cronin
*Assistant Examiner* — Sizo Vilakazi
(74) *Attorney, Agent, or Firm* — Reising Ethington P.C.

(57) ABSTRACT

A control circuit for use with an ignition system of a light-duty combustion engine. In one embodiment, the control circuit includes a charging circuit, a timing circuit and a shut down circuit that includes a manual stop switch. Activation of the manual stop switch causes the control circuit to shut down the engine, and can do so even if the manual stop switch is only momentarily engaged by the operator.

17 Claims, 2 Drawing Sheets

CONTROL CIRCUIT FOR CAPACITOR DISCHARGE IGNITION SYSTEM

FIELD OF THE INVENTION

The present invention generally relates to an ignition system for use with an engine, and more particularly, to a capacitor discharge ignition system having a control circuit.

BACKGROUND OF THE INVENTION

Capacitor discharge ignition (CDI) systems are widely used with internal combustion engines, especially light duty combustion engines employed by hand-held tools. In addition to a number of other components, a CDI system typically has some type of stop switch that allows an operator to shut the engine down when it is running. Stop switches can include, but are not limited to, on/off switches, momentary switches, and positive off/automatic on type switches.

On/off switches generally involve an operator moving the switch to a desired state before the engine can operate in that state. For instance, if an engine is running and the operator wishes to turn it off, then the operator must move the on/off switch to the 'off' position. Before the operator can turn the engine on again, the on/off switch must be moved to the 'on' position; thus, turning the engine off and on requires a minimum of two activations of the on/off switch.

Momentary switches, on the other hand, require an operator to hold down the switch while the engine shuts down; if the switch is not engaged for the requisite amount of time, then it is possible for the engine to resume operation when the operator disengages it. Unlike on/off switches, momentary switches do not require the switch to be reset back to some 'on' position before the engine can be restarted.

Positive off/automatic on switches allow an operator to shut the engine down simply by pressing the switch for a brief moment, after which the switch automatically resets such that the engine can be restarted without further switch activation. As previously stated, the aforementioned on/off switch types are only examples of some of the different switch types that can be used by CDI systems, as others also exist.

SUMMARY OF THE INVENTION

According to one aspect, there is provided a control circuit for use with an ignition system that includes a charging circuit, a timing circuit, and a shutdown circuit. The charging circuit includes a charge coil and an ignition capacitor, and the charge coil is coupled to the ignition capacitor and charges the ignition capacitor during operation. The timing circuit includes a trigger coil and an ignition switching device, and the trigger coil is coupled to the ignition switching device and provides the ignition switching device with a first portion of the charge that is induced in the trigger coil, and the ignition switching device is coupled to the ignition capacitor and discharges the ignition capacitor during operation. The shut down circuit includes a manual stop switch, a shut down capacitor, and a shut down switching device, and the shut down capacitor is coupled to the trigger coil and is charged with a second portion of the charge that is induced in the trigger coil, and the shut down switching device is coupled to both the shut down capacitor and the ignition switching device. Following activation of the manual stop switch: i) the shut down switching device is initially turned 'on', ii) the shut down capacitor discharges through the shut down switching device and turns 'on' the ignition switching device, iii) the ignition switching device shorts the ignition capacitor and prevents it from charging, and iv) the shut down switching device remains 'on' so long as current from the shut down capacitor and/or the trigger coil flows through the shut down switching device.

According to another aspect, there is provided a control circuit for use with an ignition system that includes a charging circuit, a timing circuit, and a shutdown circuit. The charging circuit includes a charge coil and an ignition capacitor, and the charge coil is coupled to the ignition capacitor and charges the ignition capacitor during operation. The timing circuit includes a trigger coil and an ignition switching device, and the trigger coil is coupled to the ignition switching device, and the ignition switching device is coupled to the ignition capacitor and discharges the ignition capacitor during operation. The shut down circuit includes a manual stop switch, a stop switch capacitor, a shut down coil, and a shut down switching device. The manual stop switch is coupled to both the shut down coil and the stop switch capacitor, and the shut down switching device is coupled to both the stop switch capacitor and the ignition switching device. Following activation of the manual stop switch: i) the shut down coil charges the stop switch capacitor through the manual stop switch, ii) the stop switch capacitor turns 'on' the shut down switching device, iii) the shut down switching device turns 'on' the ignition switching device, and iv) the ignition switching device shorts the ignition capacitor and prevents it from charging.

According to yet another aspect, there is provided a method of stopping a light-duty combustion engine. The method includes the steps of: charging a first capacitor with charge that is induced in a first coil, wherein the first coil charges the first capacitor through a manual stop switch; charging a second capacitor with charge that is induced in a second coil; activating a first switching device with charge from the first capacitor; activating a second switching device with charge from the second capacitor, wherein the second capacitor provides charge to the second switching device through the first switching device; discharging charge on an ignition capacitor with the second switching device, wherein activation of the second switching device prevents the ignition capacitor from further charging; and periodically providing charge to the first switching device so that the first and second switching devices remain activated until the engine stops.

BRIEF DESCRIPTION OF THE DRAWINGS

These and other objects, features and advantages of the present invention will be apparent from the following detailed description of the preferred embodiments and best mode, appended claims and accompanying drawings, in which:

DETAILED DESCRIPTION

Referring to the figures, there is shown a capacitive discharge ignition (CDI) system 10 for use with an internal combustion engine. CDI system 10 can be used with one of a number of types of internal combustion engines, but is particularly well suited for use with light-duty combustion engines. The term 'light-duty combustion engine' broadly includes all types of non-automotive combustion engines, including two- and four-stroke engines used with hand-held power tools, lawn and garden equipment, lawnmowers, weed trimmers, edgers, chain saws, snowblowers, personal watercraft, boats, snowmobiles, motorcycles, all-terrain-vehicles, etc. As will be explained in greater detail, CDI system 10 can include one of a number of control circuits, including the exemplary embodiment described in relation to FIG. 2.

Figure 1:
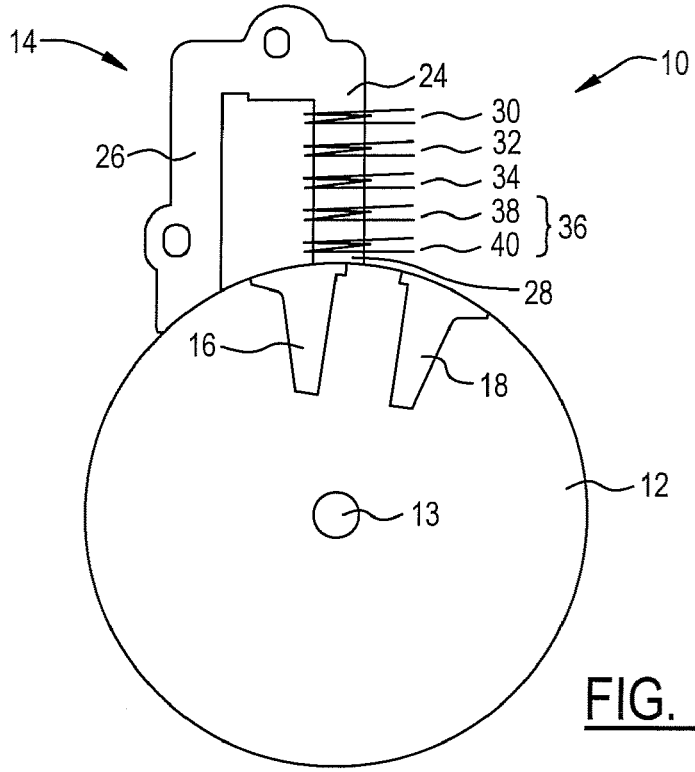
FIG. 1 shows a capacitor discharge ignition (CDI) system generally having a stator assembly mounted adjacent a rotating flywheel.

With reference to FIG. 1, CDI system 10 generally includes a flywheel 12 rotatably mounted on an engine crankshaft 13, a stator assembly 14 mounted adjacent the flywheel, and a control circuit (not shown in FIG. 1). Flywheel 12 rotates with the engine crankshaft 13 such that it induces a magnetic flux in the nearby stator assembly 14, and generally includes a permanent magnetic element having pole shoes 16, 18.

Stator assembly 14 is separated from the rotating flywheel 12 by a measured air gap (e.g. the air gap may be 0.3 mm), and generally includes a lambstack 24 having first and second legs 26, 28, a charge coil 30, a trigger coil 32, a shut down coil 34, and an ignition coil 36 having primary and secondary windings 38, 40. The lambstack 24 is a generally U-shaped ferrous armature made from a stack of laminated iron plates, and is preferably mounted to a housing (not shown) located on the engine. Preferably, charge coil 30, trigger coil 32, shut down coil 34, and ignition coil 36 are all wrapped around a single leg of lambstack 24. Such an arrangement may result in a cost savings due to the use of a common ground and a single spool or bobbin for all of the windings. Ignition coil 36 is a step-up transformer having both the primary and secondary windings 38, 40 wound around second leg 28 of the lambstack 24. Primary winding 38 is coupled to the control circuit, as will be explained, and the secondary winding 40 is coupled to a spark plug 42 (shown in FIG. 2). As is appreciated by those skilled in the art, primary winding 38 has comparatively few turns of relatively heavy wire, while secondary winding 40 has many turns of relatively fine wire. The ratio of turns between primary and secondary windings 38, 40 generates a high voltage potential in the secondary winding 40 that is used to fire spark plug 42 or provide an electric arc and consequently ignite an air/fuel mixture in the combustion chamber.

The control circuit is coupled to stator assembly 14 and spark plug 42 and generally controls the energy that is induced, stored and discharged by CDI system 10. The term "coupled" broadly encompasses all ways in which two or more electrical components, devices, circuits, etc. can be in electrical communication with one another; this includes but is certainly not limited to, a direct electrical connection and a connection via an intermediate component, device, circuit, etc. The control circuit can be provided according to one of a number of embodiments, including the exemplary embodiment shown in FIG. 2.

Figure 2:
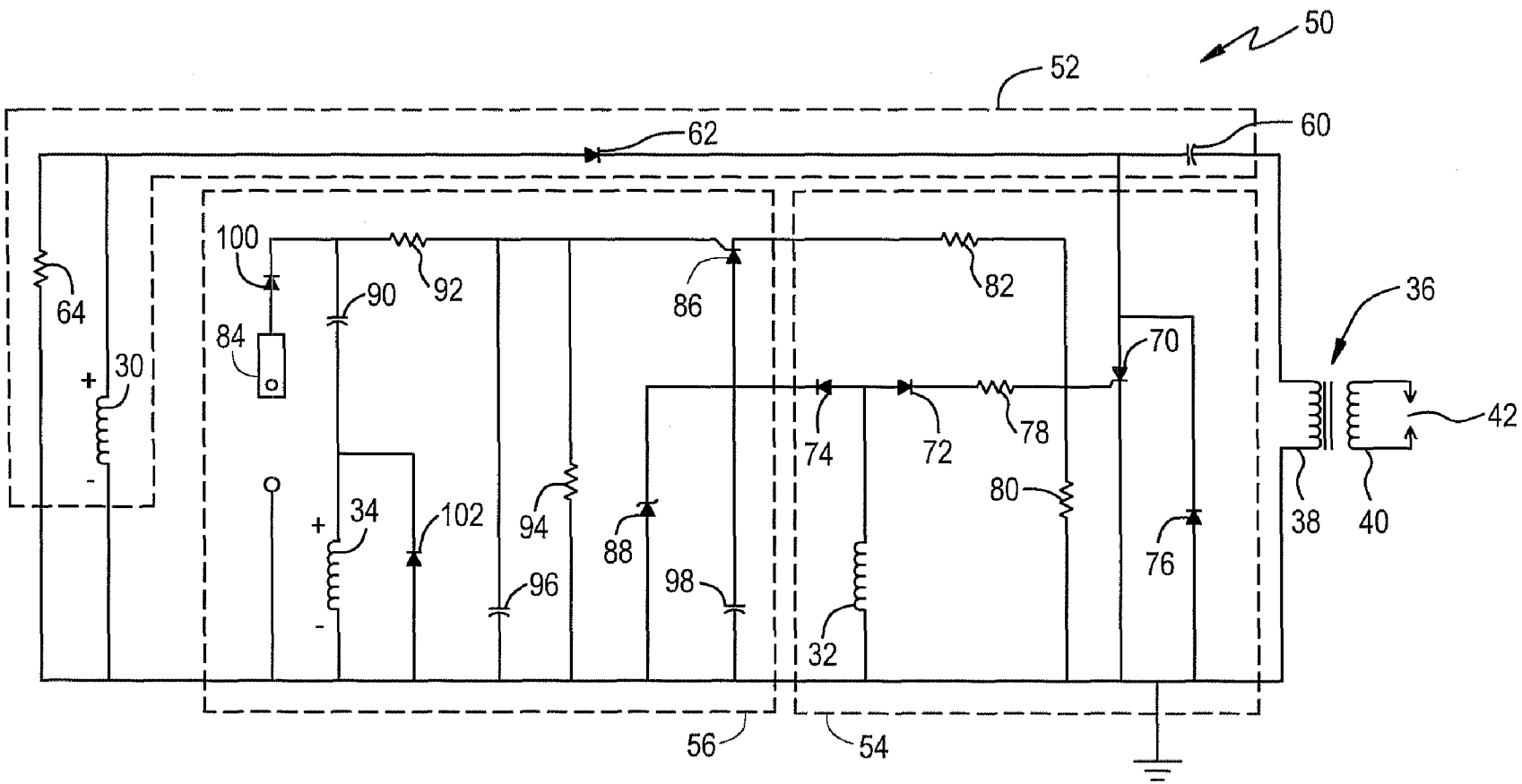
FIG. 2 is a schematic diagram of an embodiment of a control circuit that can be used with the CDI system of FIG. 1.

Turning now to FIG. 2, there is shown an embodiment of an analog control circuit 50 for controlling the energy that is induced, stored and discharged in the form of ignition pulses. Control circuit 50 is coupled to the various coils 30, 32, 34, 36 of CDI system 10, and generally includes a charging circuit 52, a timing circuit 54, and a shut down circuit 56.

Charging circuit 52 generates and stores the energy for ignition pulses that are eventually sent to spark plug 42, and generally includes charge coil 30, ignition capacitor 60, diode 62, and resistor 64. As previously discussed, charge coil 30 is carried on the second leg 28 of the lambstack 24 and, according to one exemplary embodiment, includes 4200 turns of 30 American Wire Gauge (AWG) wire. The majority of the energy induced in charge coil 30 is dumped onto ignition capacitor 60, which stores the induced energy until the timing circuit 54 instructs it to discharge. According to one exemplary embodiment, capacitor 60 can have a capacitance of about 0.47 μF, for example, and can comprise a polyethylene terephthalate (PET) stacked film or any other thick-film type arrangement, for example. In one embodiment, capacitor 60 can deliver approximately 375 volts to the ignition coil 36. According to an embodiment shown here, a positive terminal of charge coil 30 is coupled to the diode 62, which in turn is coupled to ignition capacitor 60. In one embodiment, the diode 62 is rated for a working voltage of 2,000 volts (V). Resistor 64 is generally coupled in parallel to the charge coil 30 and can produce a resistance of 30 Kilo-Ohms (KΩ).

Timing circuit 54 generates a trigger signal that discharges ignition capacitor 60 at the appropriate time, thereby creating a corresponding ignition pulse that is sent to spark plug 42. The timing circuit 54 generally includes trigger coil 32; an ignition switching device 70; diodes 72, 74, 76; and resistors 78, 80, and 82. As mentioned before, trigger coil 32 is preferably carried on the second leg 28 of lambstack 24 and according to a preferred embodiment has about 150 turns of 39 AWG wire. Trigger coil 32 periodically sends a trigger signal to the ignition switching device 70, which is preferably a silicon-controlled rectifier (SCR) type switch but could be any appropriate switching device known to those skilled in the art.

As shown in the schematic, ignition switching device 70 is wired such that when it is "on", a conductive discharge path is created between ignition capacitor 60 and ground. Once triggered, the switching device 70 may stay on until current no longer passes through the switching device 70. Diodes 72 and 74 are coupled to the positive terminal of the trigger coil 32. Diode 72 is also coupled to the gate of the ignition switching device 70 and diode 74 is coupled to the input of a shutdown switching device that will be described below. These diodes 72 and 74 can have working voltages of 100 V, for example. Also, diode 76 is generally wired in parallel with the ignition switching device 70 and can have working voltage of 400 V, for example. Coupled to the gate of ignition switching device 70 are resistors 78, 80, and 82, which can form a voltage divider network and can have resistance values of 8.2 KΩ, 820Ω, and 820Ω, respectively.

Shut down circuit 56 generates a shut down signal for shutting down the engine in response to manual stop switch activation, and generally includes the aforementioned shut down coil 34, manual stop switch 84, a shut down switching device 86, a zener diode 88, a stop switch capacitor 90, circuit 56 includes other electrical components such as resistors 92, 94, capacitor 96, a shut down capacitor 98, and diodes 100, 102. Manual stop switch 84 is preferably an operator-controlled, momentary switch having a positive off/automatic on feature. However, it could be another switch type known to those skilled in the art. The shut down switching device 86 is preferably an SCR or other type or switching device that once activated or turned 'on', a conductive discharge path is created regardless of the absence or presence of voltage at the gate so long as current is flowing through the current carrying terminals. The shut down switching device 86 can have a gate coupled to the manual stop switch 84 and an output coupled to the gate of the ignition switching device 70. The input of shut down switching device 86 can receive current from several sources. For instance, the shut down switching device 86 can receive current from shutdown capacitor 98 or from the trigger coil 32.

The shut down circuit 56 also includes a zener diode 88 coupled in parallel with shut down capacitor 98. The zener diode 88 may limit the amount of voltage across shut down capacitor 98. In one example, the zener diode 88 can have a breakdown voltage of 16 V. Stop switch capacitor 90 can be an electrolytic capacitor having a capacitance of 0.22 microfarads (μF), for example. Similarly, capacitor 96 and shut down capacitor 98 can also be electrolytic capacitors having respective capacitances of 0.10 μF and 100 μF, respectively, in one example. Shut down capacitor 98 is coupled with trigger coil 32 and is capable of receiving a charge from coil 32. Resistors 92 and 94 can be any one of a variety of resistor types known to those skilled in the art and can be 20 KΩ and 1.7 KΩ, respectively. Diodes 100 and 102 are similar in construction to diodes 72 and 74 described above and in one example each has a working voltage of 100 V.

During operation, rotation of flywheel 12 causes the magnetic elements, such as pole shoes 16, 18 to induce voltages in various coils arranged around the lambstack 24. One of those coils is charge coil 30, which charges ignition capacitor 60 through diode 62. Once ignition capacitor 60 is charged, it awaits a trigger signal from timing circuit 54 so that it can discharge and thereby create a corresponding ignition pulse in ignition coil 36. To discharge ignition capacitor 60, the timing circuit 54 provides a trigger signal that creates a discharge path for the energy stored on the ignition capacitor 60. Each rotation of flywheel 12 causes the pole shoes 16 and 18 to also create a magnetic flux in trigger coil 32, which in turn causes the trigger coil 32 to generate the trigger signal. The polarity of charge coil 30 and trigger coil 32 on the leg of lambstack 24 are reversed ensuring that the trigger signal is generated at a calculated time after the charge coil 30 generates its positive energy. Some of the energy induced in trigger coil 32 is provided to the ignition switching device 70 and part is provided to shut down capacitor 98. The portion of energy sent to the ignition switching device 70 is half-wave rectified by diode 72 and is applied to the gate of ignition switching device 70 through a voltage divider including resistors 78, 80.

When the ignition switching device 70 is turned 'on' (in this case, becomes conductive), the device 70 provides a discharge path for the energy stored on ignition capacitor 60. This rapid discharge of the ignition capacitor 60 causes a surge in current through the primary winding 38 of the ignition coil 36, which in turn creates a collapsing electro-magnetic field in the ignition coil 36. The collapsing electromagnetic field induces a high voltage ignition pulse in secondary winding 40, commonly referred to as 'flyback'. The ignition pulse travels to spark plug 42 which, assuming it has the requisite voltage, provides a combustion-initiating spark. Other sparking techniques, including non-flyback techniques, may be used instead.

The portion of energy sent from the trigger coil 32 to shut down capacitor 98 can charge the capacitor 98 until it reaches a voltage level substantially equal to the zener diode 88. Or in other words, the zener diode 88 clamps shut down capacitor 98 at a predetermined voltage. In one exemplary embodiment, this predetermined voltage is 16 V. Shut down capacitor 98 is held at the predetermined voltage until the shut down circuit 56 is activated. During certain periods of engine operation, the portion of energy sent from the trigger coil 32 to the shut down capacitor 98 can be greater than the portion of energy sent to the ignition switching device 70. For example, this relationship can occur while shut down capacitor 98 is charging to the 5-10 V range. As time passes and charge builds on shut down capacitor 98, this relationship can reverse so that the portion of energy sent from the trigger coil 32 to the ignition switching device 70 is greater than that sent to shut down capacitor 98. While the engine is operating normally, diode 102 keeps the voltage across the shut down coil 34 low (e.g. shorted) in order to prevent the negative voltage from the coil 34 from activating the shut down switching device 86. This process continues until shut down circuit 56 generates a shut down signal, usually in response to activation of manual stop switch 84.

Shut down circuit 56 generates a shut down signal in response to activation of manual stop switch 84, but could be designed to be activated by other events such as a signal from a microprocessor. Manual activation of manual stop switch 84 creates an electrical path between shut down coil 34 and manual stop switch 84. When the manual stop switch 84 is closed, even momentarily, current flows from the negative terminal of shut down coil 34, through stop switch 84 and diode 100 and charges stop switch capacitor 90. The voltage from the stop switch capacitor 90—which can be provided in the form of a shut down signal—can then turn 'on' the gate of shut down switching device 86 through the divider network including resistors 92, 94.

Activating the gate of shut down switching device 86 turns device 86 'on' allowing current to flow from the output of device 86 through resistor 82 to the gate of ignition switching device 70. When the shut down switching device 86 is turned 'on' shut down capacitor 98 discharges via an electrical path that includes shut down switching device 86 and resistors 80, 82; this in turn affects the state of the ignition switching device 70. When shut down switching device 86 is 'on', shut down capacitor 98 and resistors 80 and 82 form a resistor-capacitor (RC) circuit with a time constant that dictates the initial time of discharge. However, each additional rotation by the flywheel 12 creates additional pulses in the trigger coil 32; a portion of which flows through diode 74 and further biases shut down switching device 86 in the conductive state. Shut down switching device 86 remains conductive so long as current flows therethrough and the engine comes to a stop. Additional capacitors and resistors shown in shut down circuit 56 provide filtering, signal enhancement, and other functions appreciated by those skilled in the art.

Preferably, shut down switching device 86 has a holding characteristic that keeps it 'on' as long as current flows to it. Because the shut down switching device 86 will remain active even if the voltage on its gate drops, the control circuit 50 stops providing current to the ignition coil 36, regardless of the length of time that the manual stop switch 84 is manually held or the length of time the flywheel 12 rotates after stop switch 84 is closed. Energy from the shut down capacitor 98 flows through the shut down switching device 86 when discharging and current from the trigger coil 32 can maintain the shut down switching device 86 in an 'on' position while the shut down capacitor 98 is charging. Therefore, the combination of the trigger coil 32 and shut down capacitor 98 keeps the shut down switching device 86, and hence the ignition switching device 70, biased in an 'on' state until the flywheel 12 comes to a stop. The prolonged activation of both the ignition switching device 70 and the shut down switching device 86 maintains a short circuit for the charge flowing to ignition capacitor 60, and thus prevents the capacitor 60 from charging. Without charge building up on the ignition capacitor 60, no spark can occur to fire the engine. As soon as the engine comes to a stop and any stored energy has been dissipated, electrical current ceases flowing to the first and shut down switching devices 70, 86 such that they are switched to their 'off' state. Subsequently, an operator may restart the engine without delay or resetting any switch.

Figure 3:
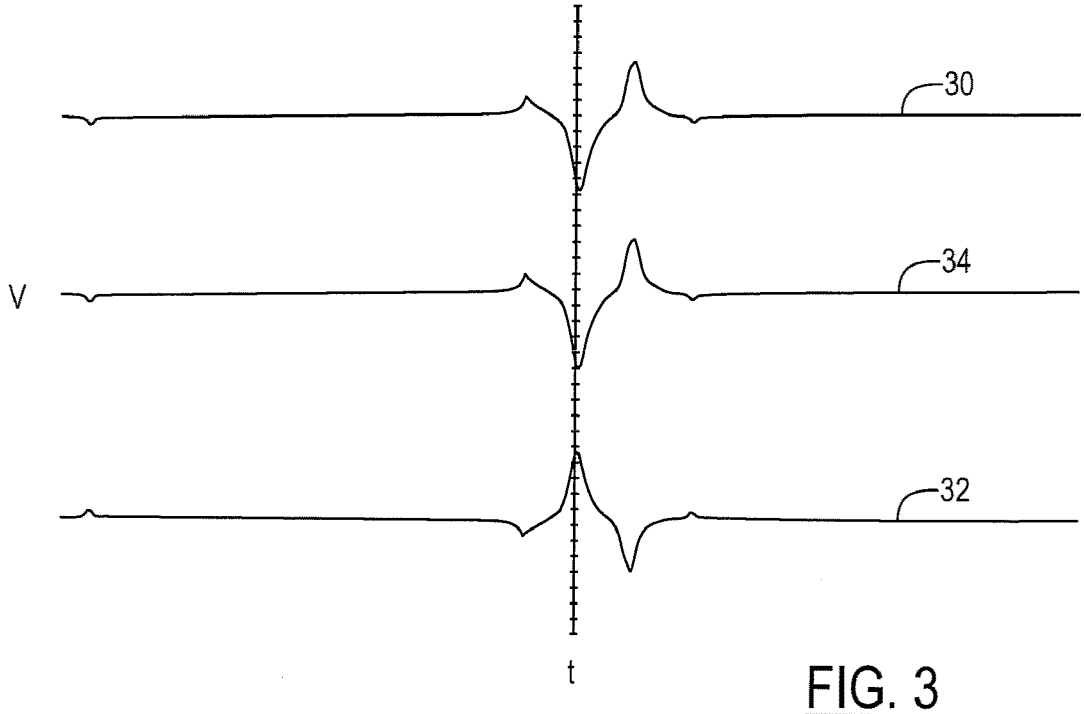
FIG. 3 is a graph showing the change in voltage relative to time in different coils of the control circuit of FIG. 2.

Turning to FIG. 3, a graph shows the voltage characteristics of the charge coil 30, the trigger coil 32, and the shut down coil 34 over a period of time. As can be appreciated in FIG. 3, the charge coil 30 and the shut down coil 34 exhibit substantially similar behaviors over time. More particularly, both the charge coil 30 and the shut down coil 34 create a similar voltage waveform over the same period of time. However, the waveform of the charge coil 30 and the waveform of the shut down coil 34 may be time-shifted, inverted, etc., depending on the physical characteristics of the ignition system 10. The inverse waveform of the trigger coil 32 can be created by using a coil 32 wound in an opposite direction than the charge coil 30 and the shut down coil 34. For instance, if the charge coil 30 and the shut down coil 34 are wound in a clockwise fashion, the trigger coil 32 can be wound in a counter-clockwise fashion. Likewise, if the charge coil 30 and the shut down coil 34 are wound in a counter-clockwise fashion, the trigger coil 32 can be wound in a clockwise fashion.

The control circuit 50 described above benefits from a number of unique features. For instance, the circuit 50 may use a one-push stop switch that ends engine operation regardless of the duration of engine rotations that take place after pressing the stop switch. An engine's residual energy can cause the flywheel to rotate for a significant amount of time after a stop switch is activated. Regardless of this amount of time, momentary activation of manual stop switch 84 of circuit 50 will stop engine operation. Differently put, ending engine operation is not based on the amount of time the manual stop switch 84 is activated.

While the embodiments explained above presently constitute the preferred embodiments, many others are also possible. In addition, while similar reference numerals have been used amongst several different embodiments, it is to be understood that various electrical components may have different values and arrangements within and between the several embodiments disclosed. It is understood that terms used herein are merely descriptive, rather than limiting, and that various changes may be made without departing from the spirit or scope of the invention as defined by the following claims.

The invention claimed is:

1. A control circuit for use with an ignition system of a light-duty combustion engine, comprising:

a charging circuit having a charge coil and an ignition capacitor, wherein the charge coil is coupled to the ignition capacitor and charges the ignition capacitor during operation;

a timing circuit having a trigger coil and an ignition switching device, wherein the trigger coil is coupled to the ignition switching device and provides the ignition switching device with a first portion of the charge that is induced in the trigger coil, and the ignition switching device is coupled to the ignition capacitor and discharges the ignition capacitor during operation; and a shut down circuit having a manual stop switch, a shut down capacitor, and a shut down switching device, wherein the shut down capacitor is coupled to the trigger coil and is charged with a second portion of the charge that is induced in the trigger coil, and the shut down switching device is coupled to both the shut down capacitor and the ignition switching device;

wherein following activation of the manual stop switch: i) the shut down switching device is initially turned 'on', ii) the shut down capacitor discharges through the shut down switching device and turns 'on' the ignition switching device, iii) the ignition switching device shorts the ignition capacitor and prevents it from charging, and iv) the shut down switching device remains 'on' so long as current from the shut down capacitor and/or the trigger coil flows through the shut down switching device.

2. The control circuit of claim 1, wherein the shut down circuit further comprises a shut down coil and a stop switch capacitor, the shut down coil is coupled to the stop switch capacitor through the manual stop switch and charges the stop switch capacitor when the manual stop switch is activated.

3. The control circuit of claim 2, wherein the stop switch capacitor is coupled to the shut down switching device and initially turns 'on' the shut down switching device when the charge on the stop switch capacitor exceeds a certain amount.

4. The control circuit of claim 1, wherein engagement of the manual stop switch for a period of one flywheel revolution causes the engine operation to cease.

5. The control circuit of claim 1, wherein the ignition switching device and the shut down switching device are both silicon controlled rectifier (SCR) switches.

6. The control circuit of claim 1, further comprising a shut down coil and an ignition coil having primary and secondary windings, wherein the charge coil, the trigger coil, the shut down coil, and the ignition coil are all carried on a single leg of a lambstack and all share a common ground.

7. The control circuit of claim 1, wherein the shut down circuit further comprises a zener diode that is coupled in parallel to the shut down capacitor and controls the voltage across the shut down capacitor.

8. The control circuit of claim 1, wherein the manual stop switch is a momentary-type stop switch biased in the open position.

9. A control circuit for use with an ignition system of a light-duty combustion engine, comprising:

a charging circuit having a charge coil and an ignition capacitor, wherein the charge coil is coupled to the ignition capacitor and charges the ignition capacitor during operation;

a timing circuit having a trigger coil and an ignition switching device, wherein the trigger coil is coupled to the ignition switching device, and the ignition switching device is coupled to the ignition capacitor and discharges the ignition capacitor during operation; and a shut down circuit having a manual stop switch, a stop switch capacitor, a shut down coil, and a shut down switching device, wherein the manual stop switch is coupled to both the shut down coil and the stop switch capacitor, and the shut down switching device is coupled to both the stop switch capacitor and the ignition switching device;

wherein following activation of the manual stop switch: i) the shut down coil charges the stop switch capacitor through the manual stop switch, ii) the stop switch capacitor turns 'on' the shut down switching device, iii) the shut down switching device turns 'on' the ignition switching device, and iv) the ignition switching device shorts the ignition capacitor and prevents it from charging.

10. The control circuit of claim 9, wherein a first portion of the charge that is induced in the trigger coil is provided to the ignition switching device and a second portion of the charge that is induced in the trigger coil is provided to a shut down capacitor.

11. The control circuit of claim 10, wherein following activation of the manual stop switch, the shut down switching device remains 'on' so long as current from the shut down capacitor and/or the trigger coil flows through the shut down switching device.

12. The control circuit of claim 9, wherein engagement of the manual stop switch for a period of one flywheel revolution causes the engine operation to cease.

13. The control circuit of claim 9, wherein the ignition switching device and the shut down switching device are both silicon controlled rectifier (SCR) switches.

14. The control circuit of claim 9, further comprising an ignition coil having primary and secondary windings, wherein the charge coil, the trigger coil, the shut down coil, and the ignition coil are all carried on a single leg of a lamb-stack and all share a common ground.

15. The control circuit of claim 9, wherein the shut down circuit further comprises a zener diode that is coupled in parallel to the shut down capacitor and controls the voltage across the shut down capacitor.

16. A method of stopping a light-duty combustion engine, comprising the steps of:

(a) charging a first capacitor with charge that is induced in a first coil, wherein the first coil charges the first capacitor through a manual stop switch;

(b) charging a second capacitor with charge that is induced in a second coil;

(c) activating a first switching device with charge from the first capacitor;

(d) activating a second switching device with charge from the second capacitor, wherein the second capacitor provides charge to the second switching device through the first switching device;

(e) discharging charge on an ignition capacitor with the second switching device, wherein activation of the second switching device prevents the ignition capacitor from further charging; and (f) periodically providing charge to the first switching device so that the first and second switching devices remain activated until the engine stops.

17. The method of claim 16, wherein the manual stop switch is a momentary-type stop switch biased in the open position.

* * * * *